US007946520B2

(12) United States Patent
Roman

(10) Patent No.: US 7,946,520 B2
(45) Date of Patent: May 24, 2011

(54) ELASTIC REWINDING HOSE REEL WITH AUTOMATIC STOPPING DEVICE

(75) Inventor: Gianfranco Roman, Pasiano (IT); Franca Serafin, legal representative, Pasiano (IT); Giada Roman, legal representative, Codroipo (IT)

(73) Assignee: Claber S.p.A., Fiume Veneto (PN) (IT)

( * ) Notice: Subject to any disclaimer, the term of this patent is extended or adjusted under 35 U.S.C. 154(b) by 0 days.

(21) Appl. No.: 12/225,723

(22) PCT Filed: Mar. 27, 2007

(86) PCT No.: PCT/EP2007/052919
§ 371 (c)(1),
(2), (4) Date: Sep. 29, 2008

(87) PCT Pub. No.: WO2007/113171
PCT Pub. Date: Oct. 11, 2007

(65) Prior Publication Data

US 2009/0189005 A1 Jul. 30, 2009

(30) Foreign Application Priority Data

Mar. 31, 2006 (IT) ..... MI2006A0622

(51) Int. Cl.
*B65H 75/30* (2006.01)

(52) U.S. Cl. ..... 242/385.1; 242/396.1; 137/355.21

(58) Field of Classification Search ..... 242/385.1, 242/394, 394.1, 396.2, 396.5, 396.6, 396.1, 242/396.8, 385, 396, 396.9, 398, 389, 371, 242/370; 137/355.21, 355.2
See application file for complete search history.

(56) References Cited

U.S. PATENT DOCUMENTS

| | | | | |
|---|---|---|---|---|
| 1,950,833 | A * | 3/1934 | Woodford | 242/377 |
| 2,584,559 | A * | 2/1952 | Dalrymple | 137/355.22 |
| 6,416,009 | B1 * | 7/2002 | Iaciofano et al. | 242/384.7 |
| 6,619,313 | B2 * | 9/2003 | Boughton et al. | 137/355.16 |

FOREIGN PATENT DOCUMENTS

| | | | |
|---|---|---|---|
| DE | 202 21 032 | | 12/2004 |
| GB | 1 495 652 | | 12/1977 |
| GB | 1495652 | * | 12/1977 |

OTHER PUBLICATIONS

International Search Report dated Jun. 6, 2007.

* cited by examiner

*Primary Examiner* — Michael R Mansen
*Assistant Examiner* — Juan J Campos
(74) *Attorney, Agent, or Firm* — Jacobson Holman PLLC

(57) ABSTRACT

A hose reel includes a support casing, a drum rotatably fitted inside the casing and connected to it by an elastic rewinding element. The drum provides a flange integral with it and couplable in rotation with a locking disc equipped with teeth engageable with opposing teeth capable of stopping its rotation. An elastic separator is provided between the flange and the locking disc to keep the latter in a first position axially distanced from the flange, teeth and counter-teeth mutually engaged to allow the flange to draw the locking disc into integral rotation with it, and cam and counter-cam which, in the event of the flange exceeding a predetermined threshold speed cause the axial displacement of the locking disc into a second position adjoining the flange in which its teeth engage with the opposing teeth to produce the consequent stopping of the rotation of said drum.

4 Claims, 12 Drawing Sheets

ELASTIC REWINDING HOSE REEL WITH AUTOMATIC STOPPING DEVICE

This is a national stage of PCT/EP2007/052919 filed Mar. 27, 2007 and published in English.

FILED OF THE INVENTION

The present invention concerns an elastic rewinding hose reel with automatic stopping device.

BACKGROUND OF THE INVENTION

The hose reel is a very useful tool when one needs to operate with very long flexible hoses, and comprises a drum rotatably coupled to a casing.

Hose reels are known in which, in order to facilitate the winding of the hose, the drum/casing coupling is made through elastic means which force the rotation of the drum in the direction usable for rewinding a partially or totally unrolled hose.

Said known hose reels have the disadvantage that, once the operator has started the winding process, the drum tends to accelerate, making the manual stopping of the hose by the operator difficult and often forcing the end of the hose, usually fitted with a terminal lance, to finish its run violently against the casing, with the consequent possibility of damage to both.

Hose reels are known including a device to slow the hose down, which reduces the speed of winding but does not solve the problem in the case of total rewinding of the hose. In this case also it is necessary to go back to the casing and recover the hose.

Hose reels are also known having a hook fixed to the casing which can engage with teeth located on half the face of the drum. The interaction between hook and teeth locks the drum. The braking/locking action is performed solely by half the face of the drum, and for this reason the stopping is not certain and depends on the angle of rotation of the drum with respect to the position of the hook.

If the hose has unrolled almost completely, and one decides to roll it up completely, the drum picks up such a speed that the end of the hose stops suddenly when it re-enters the casing. The problems of wear and tear mentioned above present themselves once more.

SUMMARY OF THE INVENTION

The object of the present invention is to create a hose reel comprising a stopping device capable of locking the drum in the event that its winding rotation speed exceeds a threshold value because of which the winding of the hose is judged to be excessive and harmful for the hose reel.

In accordance with the invention, this object is achieved with a hose reel comprising a support casing, a drum rotatably fitted inside said casing and connected to it by elastic rewinding means, characterised in that said drum provides a flange integral with it and couplable in rotation with a locking disc equipped with teeth and movable between a first position axially distanced from said flange and a second position axially adjoining said flange in which said teeth on the locking disc engage with opposing teeth capable of arresting its rotation, there being provided elastic separation means interposed between said flange and said locking disc to maintain the latter in said first position, teeth and counter-teeth means respectively integral with said flange and said locking disc which are mutually engaged so as to allow said flange to draw said locking disc into integral rotation with it, and cam and counter-cam means respectively integral with said flange and said locking disc which in the event of a predetermined threshold speed being exceeded by said flange cause the axial displacement of said locking disc into said second position to produce the consequent stopping of the drum's rotation.

The threshold speed is established at the stage of designing and assembling the various components.

The end of the hose can always be recovered at a short distance from the operator and does not return violently into the casing.

The opposing teeth which bring about the stopping of the integral rotation of the locking disc and the flange, and therefore of the drum, can be integral with the support casing of the drum, but preferably they are formed on a stopping disc which is axially held against said casing with the interposition of a friction ring capable of allowing a limited rotation of said stopping disc with respect to said casing in the event that the speed of rotation of said locking disc exceeds said predetermined threshold by a pre-established value.

In this way, if the rewinding speed were such as to bring about the engagement of the teeth on the locking disc with the opposing teeth, with sufficient force to cause possible failure and/or breakage, the stopping disc would be allowed a limited rotatory slipping movement against the friction ring, which would avoid a sudden and damaging impact between the teeth of the two discs coming into mutual engagement.

The slipping of the stopping disc against the friction ring would exhaust itself almost immediately as a result of the high frictional forces present, but it would be sufficient to absorb the powerful stresses which would otherwise develop at the moment of impact between the teeth on the locking disc and the opposing teeth.

BRIEF DESCRIPTION OF THE DRAWINGS

These and other characteristics of the present invention will be made more clearly evident by the following detailed description of an example of its practical embodiment which is illustrated without limiting effect in the attached drawings, in which.

DETAILED DESCRIPTION OF THE PREFERRED EMBODIMENTS

Figure 1:
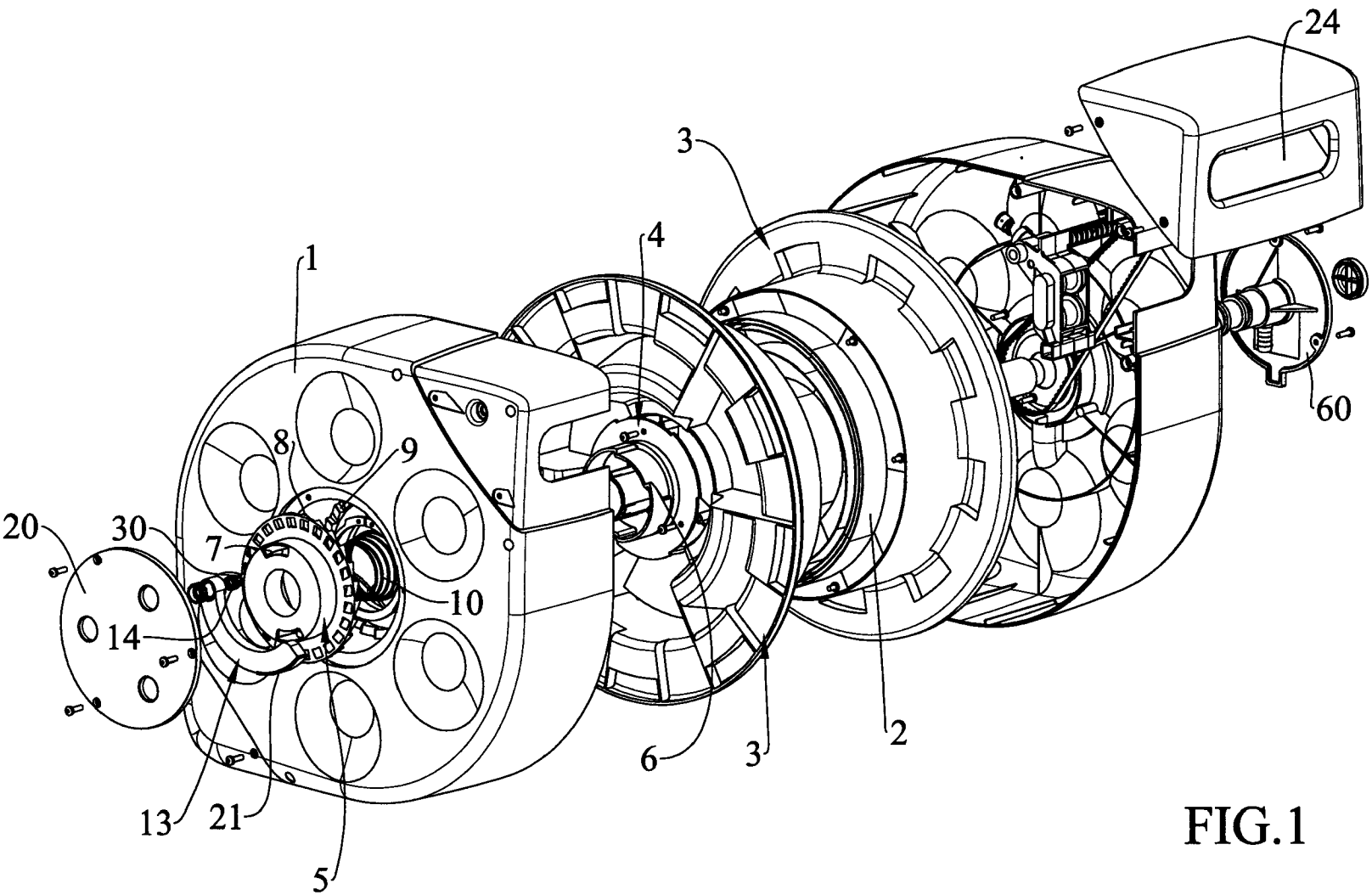
FIG. 1 shows an exploded perspective view of a hose reel according to the present invention.
Figure 2:
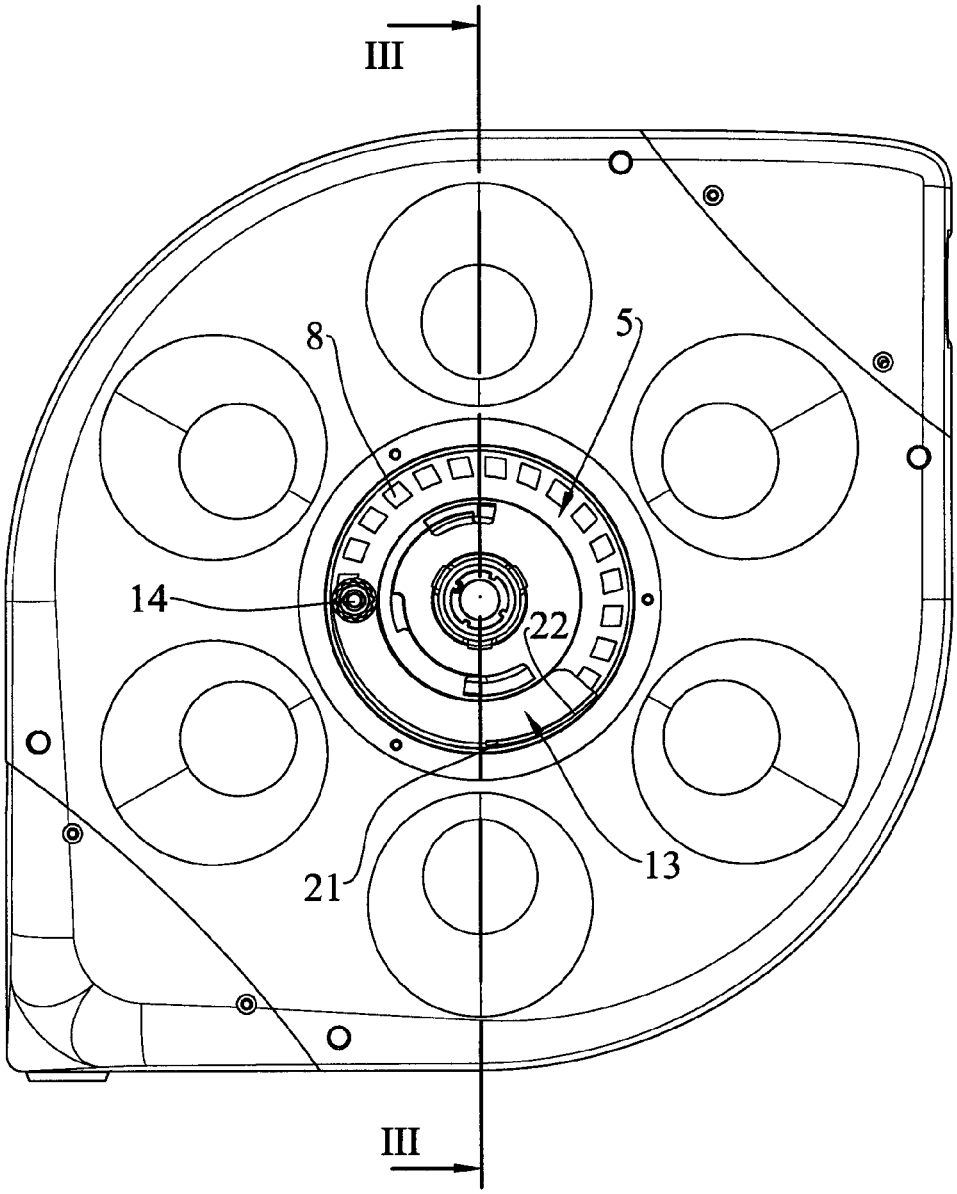
FIG. 2 shows a side view of the hose reel.

The hose reel illustrated in the drawings comprises a casing 1 which rotatably supports a rotating drum 3 stressed in an angular rest position by a rewind spring 2 and having a flange 4 coupled in axially and rotatably movable manner to a locking disc 5, having furthermore teeth 8 engageable with opposing teeth 9 on casing 1.

Figure 11:
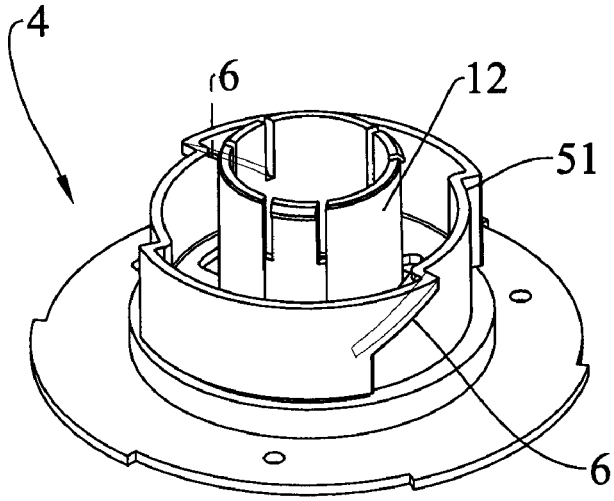
FIG. 11 shows a perspective view of the flange on the drum.
Figure 12:
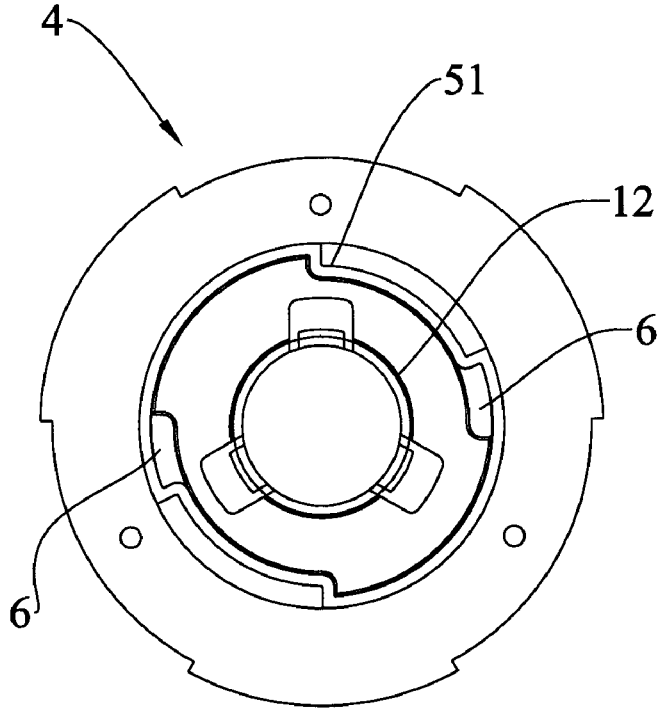
FIG. 12 shows a plan view from above of the flange on the drum.
Figure 13:
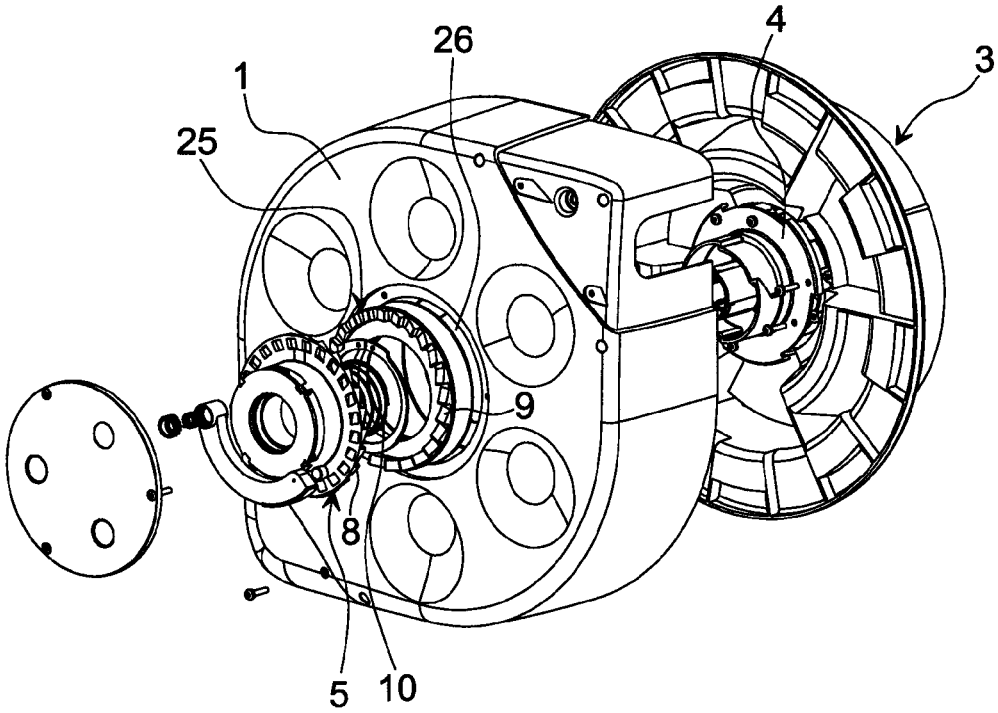
FIG. 13 shows an exploded perspective view of a part of the hose reel of the present invention according to a preferred variant of it.
Figure 14:
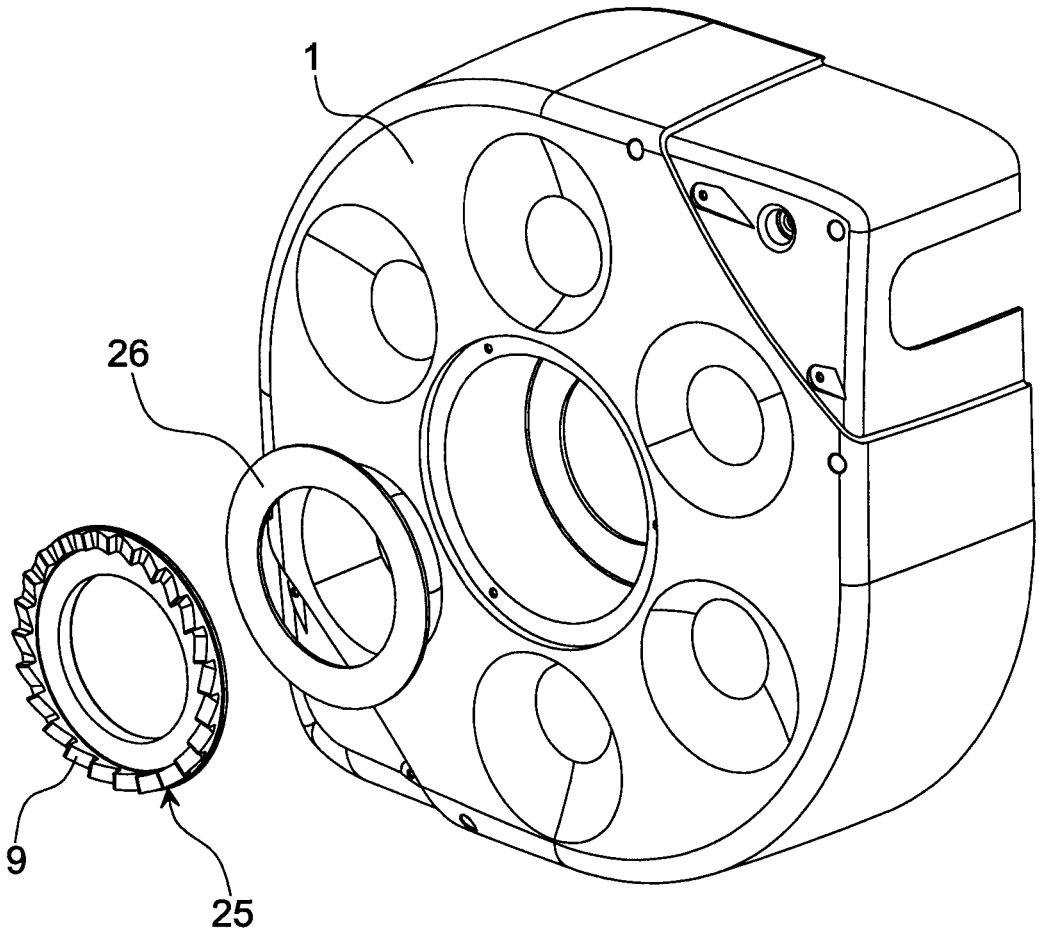
FIG. 14 shows in greater detail some elements of FIG. 13.
Figure 15:
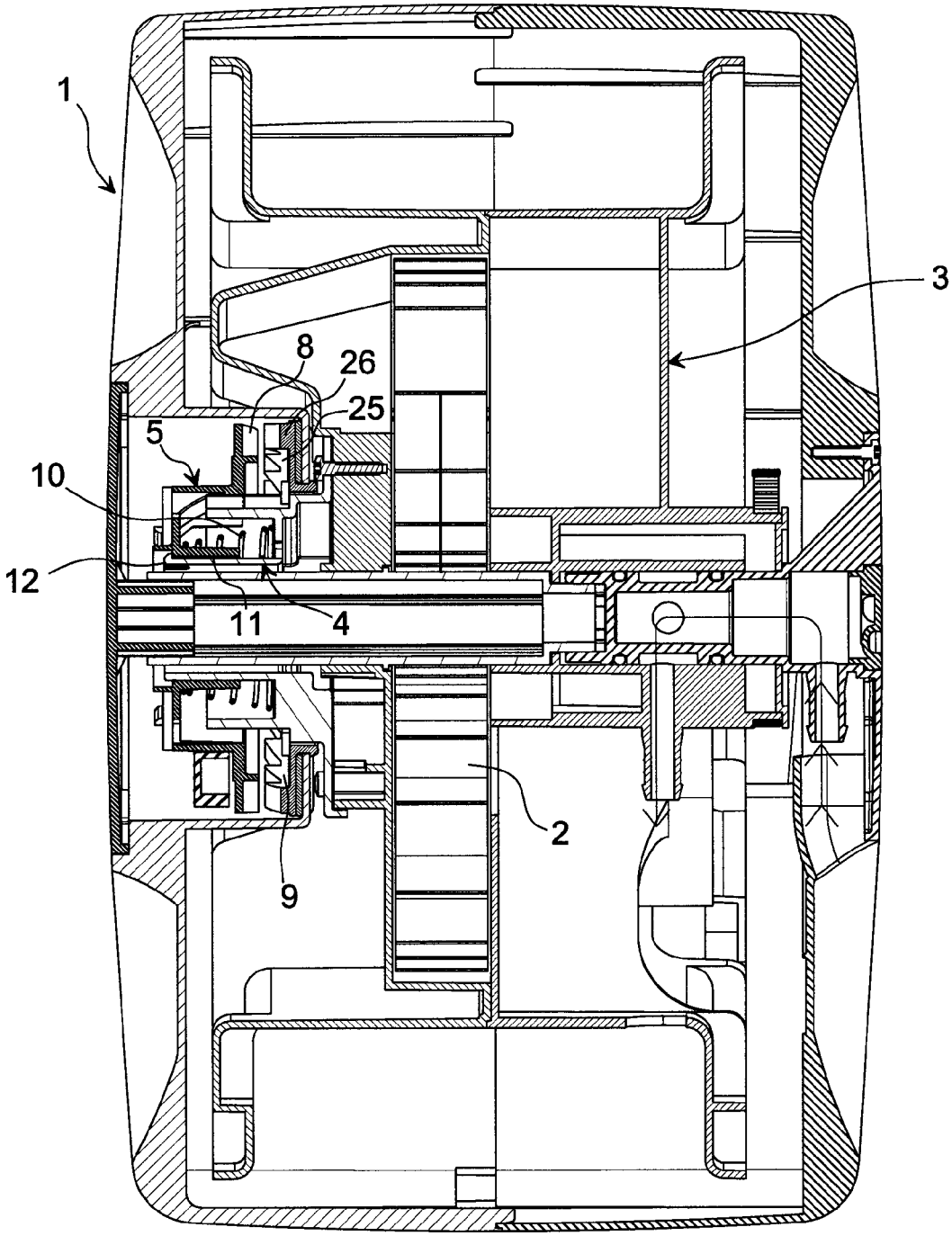
FIG. 15 shows a sectional view similar to that in FIG. 3, referring to the variant in FIGS. 13 and 14.
Figure 16:
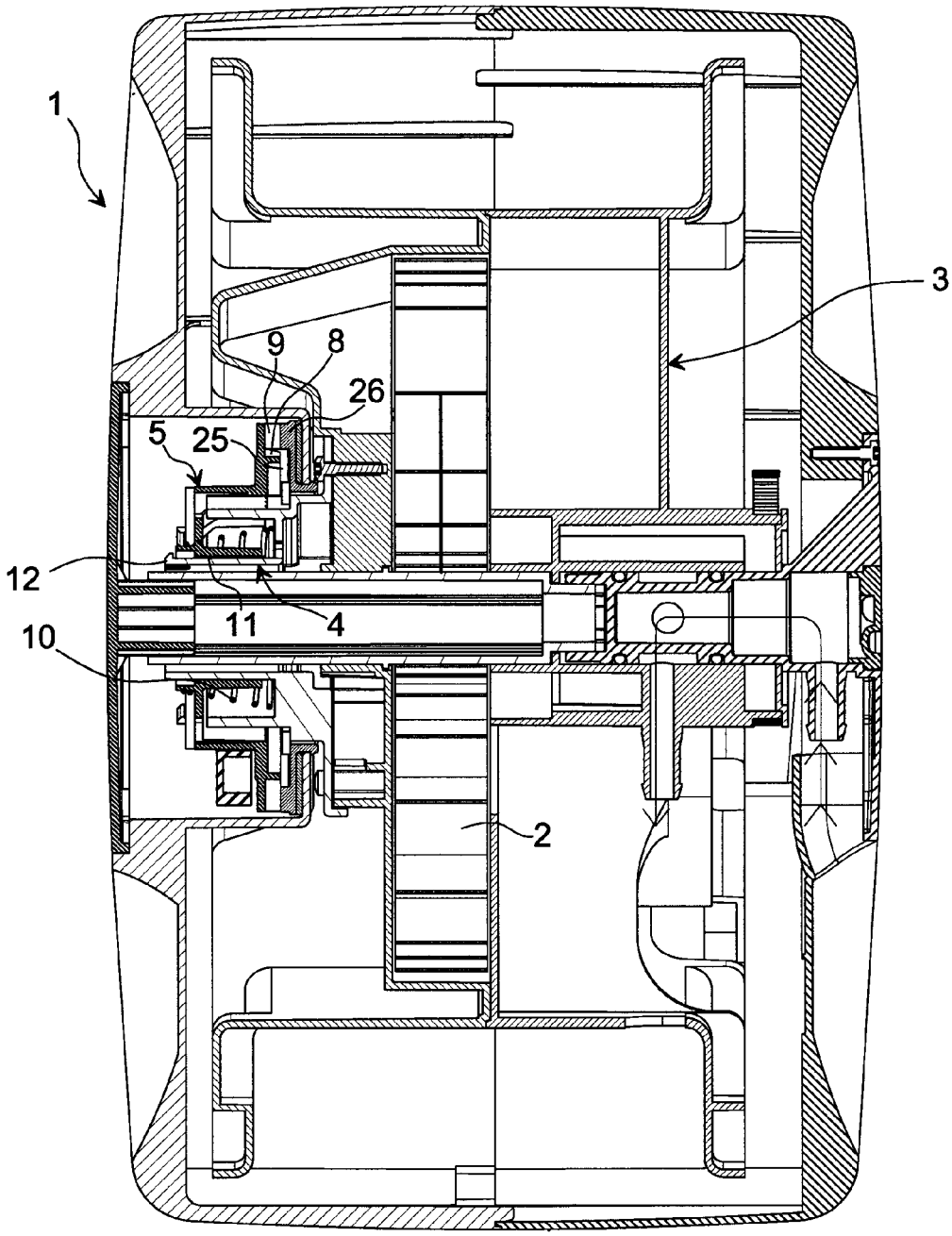
FIG. 16 shows the same sectional view as in FIG. 15 with the locking disc in the position of stopping the rewinding movement.

Said flange 4 (FIGS. 11 and 12) comprises a flat rim 100, an intermediate sleeve 101 provided with two teeth 51 and with two inclined cams 6, and a cylindrical connecting portion 12.

Figure 8:
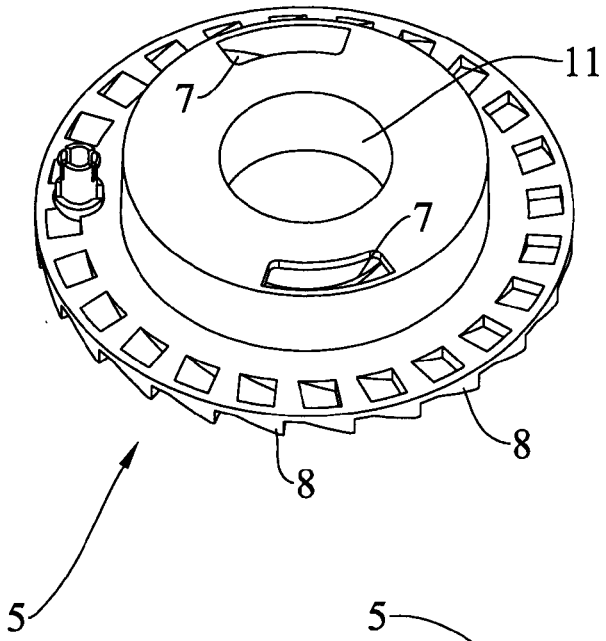
FIG. 8 shows a perspective view from above of the locking disc.
Figure 9:
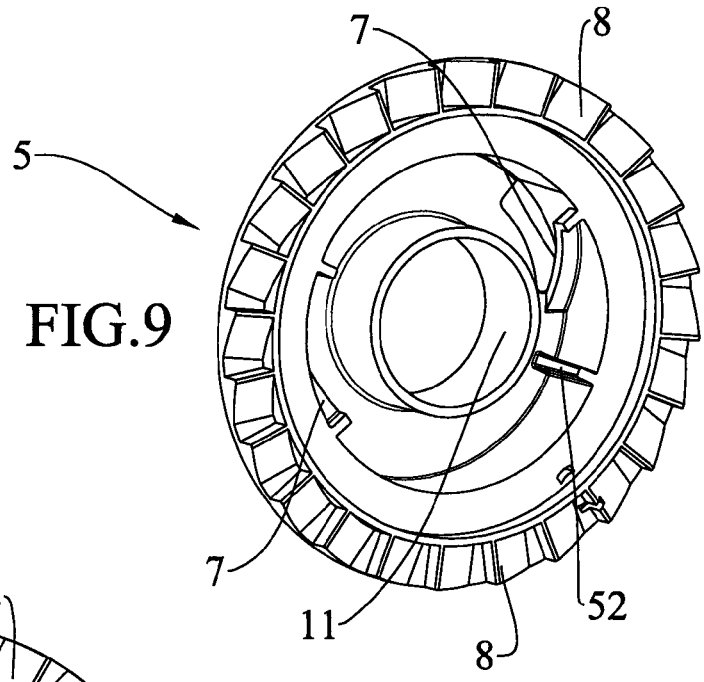
FIG. 9 shows a perspective view from below of the locking disc.
Figure 10:
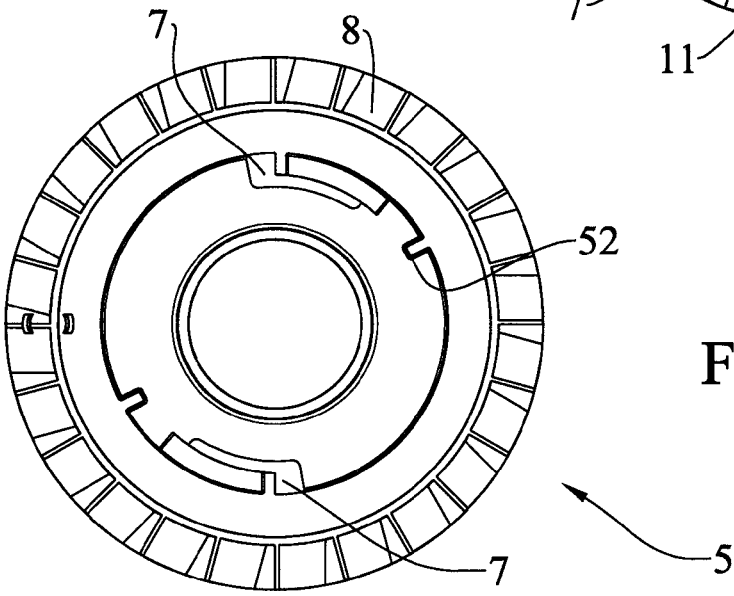
FIG. 10 shows a plan view from below of the locking disc.

The locking disc 5 (FIGS. 8-10) comprises a rim 102 provided with a circular succession of teeth 8, an intermediate sleeve 103 provided with two counter-teeth 52 and with two inclined counter-cams 7 and a cylindrical sleeve 11.

Figure 3:
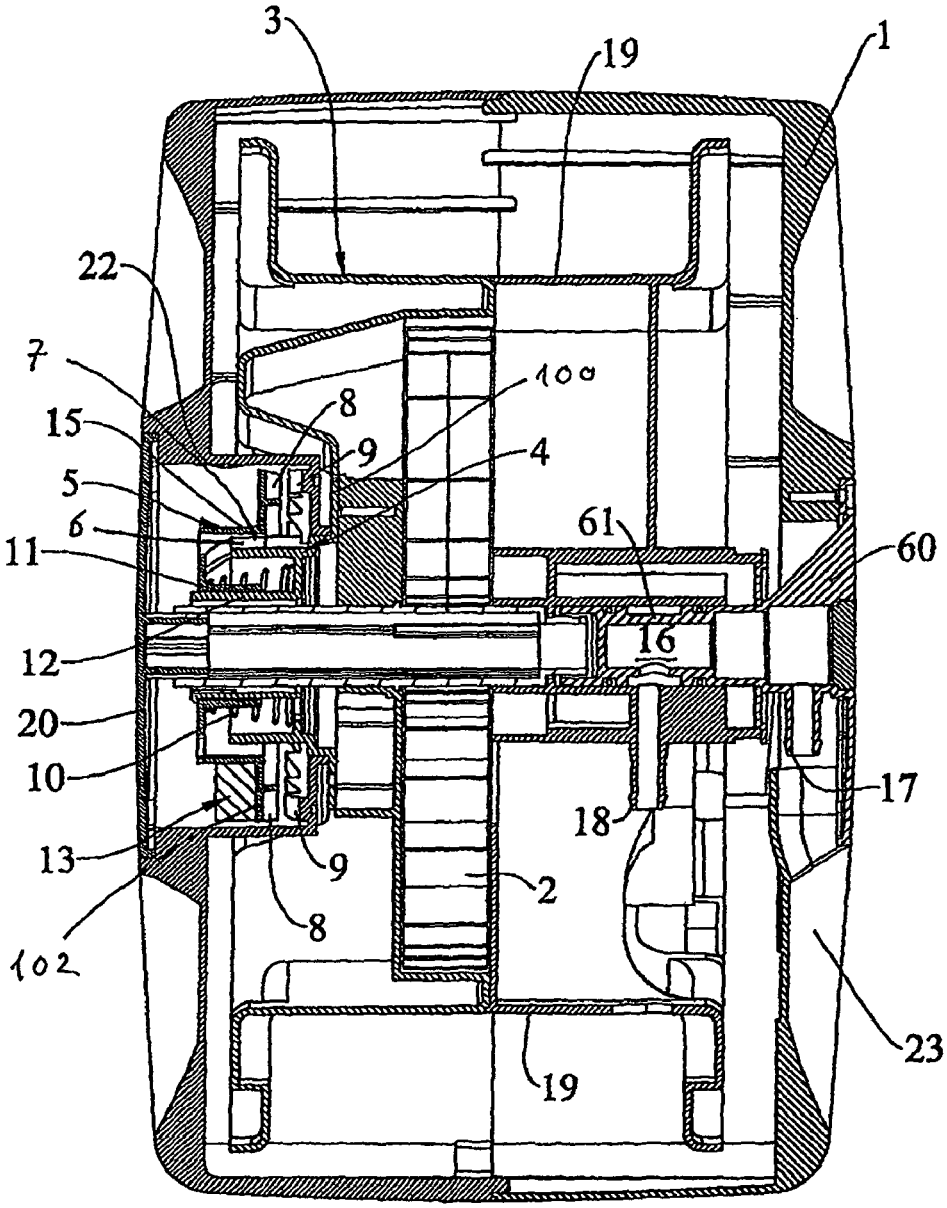
FIG. 3 shows a sectional view along line III-III in FIG. 2 with the locking disc in a rest position.
Figure 4:
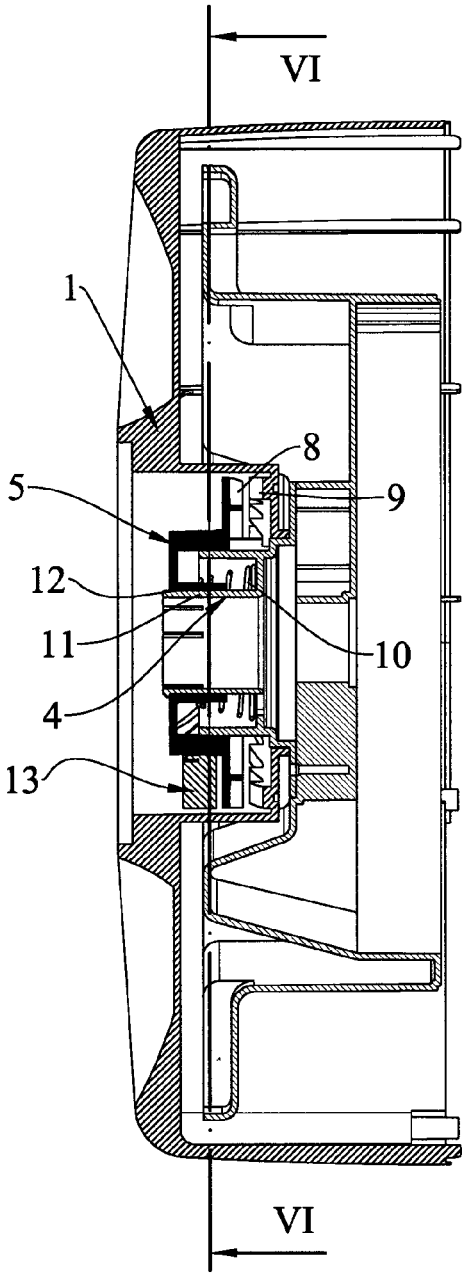
FIG. 4 shows a view in partial section similar to that in FIG. 3 with the locking disc disconnected from the casing.

The cylindrical sleeve 11 of the locking disc 5 is slidably and rotatably mounted on a connecting portion 12 of the flange 4 and the teeth 51 and the cams 6 and the counter-cams 7 are always engaged with each other, while a pre-compressed separating spring 10 provided between disc 5 and flange 4 keeps the rim 102 of the locking disc 5 axially distanced from the rim 100 of the flange and the teeth 8 on disc 5 disengaged from the opposed teeth 9 on casing 1, as shown in FIGS. 3 and 4.

The hose reel includes furthermore a curved brake shoe 13 (FIG. 1) pivoting on disc 5 by means of a pin 30, there being also provided a spring 14 (FIG. 1) near said pin 30 to keep said shoe adhering to a peripheral surface 15 of disc 5.

The shoe 13 includes an external portion 21 in friction material designed to interact with an internal annular surface 22 of casing 1 in order to brake disc 5 with respect to drum 3.

The casing 1 includes a first cover 20 and a second cover 60 with an entry zone 23 (FIG. 3) for a flexible hose for fluid intake, an axial shank 61 equipped with seals, and an outlet port 24 (FIG. 1) for a flexible hose wound onto a peripheral surface 19 of drum 3.

The shank 61 has a central axial duct 16 for the passage of the fluid coming from an external source through a first nozzle 17 to which the above-mentioned intake hose is attached. A second nozzle 18 allows the fluid to enter the flexible hose (not shown) which is wound onto drum 3.

As regards operation, let us consider the hose reel in the configuration shown in FIG. 4, i.e. with the drum 3 free to rotate following forced rewinding by rewind spring 2.

Before rewinding, the cams 6 of the flange are the counter-cams 7 of the locking disc 5 are mutually engaged, while the rims 100 and 102 are kept at a distance which takes the teeth 8 of the locking disc 5 disengaged from the opposed teeth 9 of the casing 1.

Figure 5:
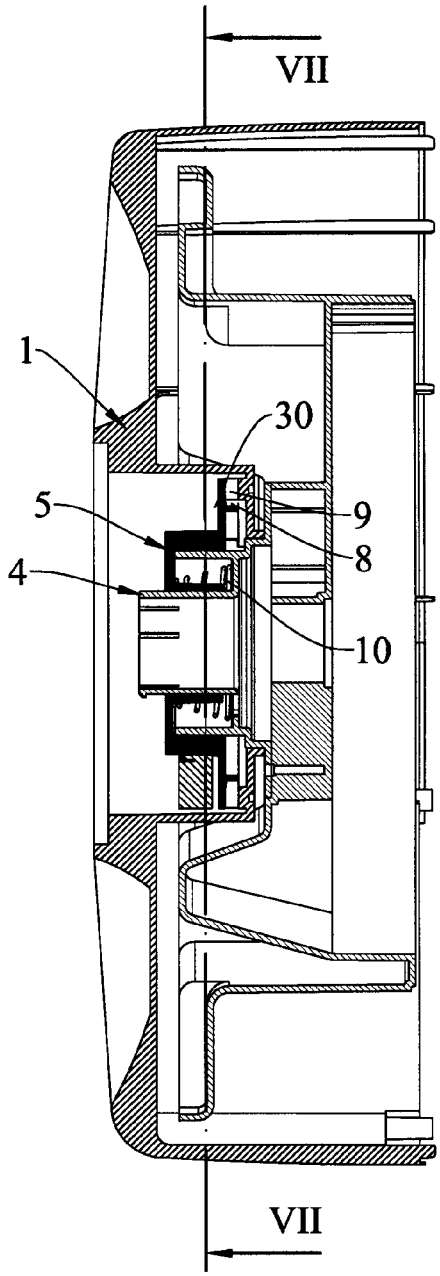
FIG. 5 shows a view in partial section similar to that in FIG. 3 with the locking disc connected to the casing.
Figure 6:
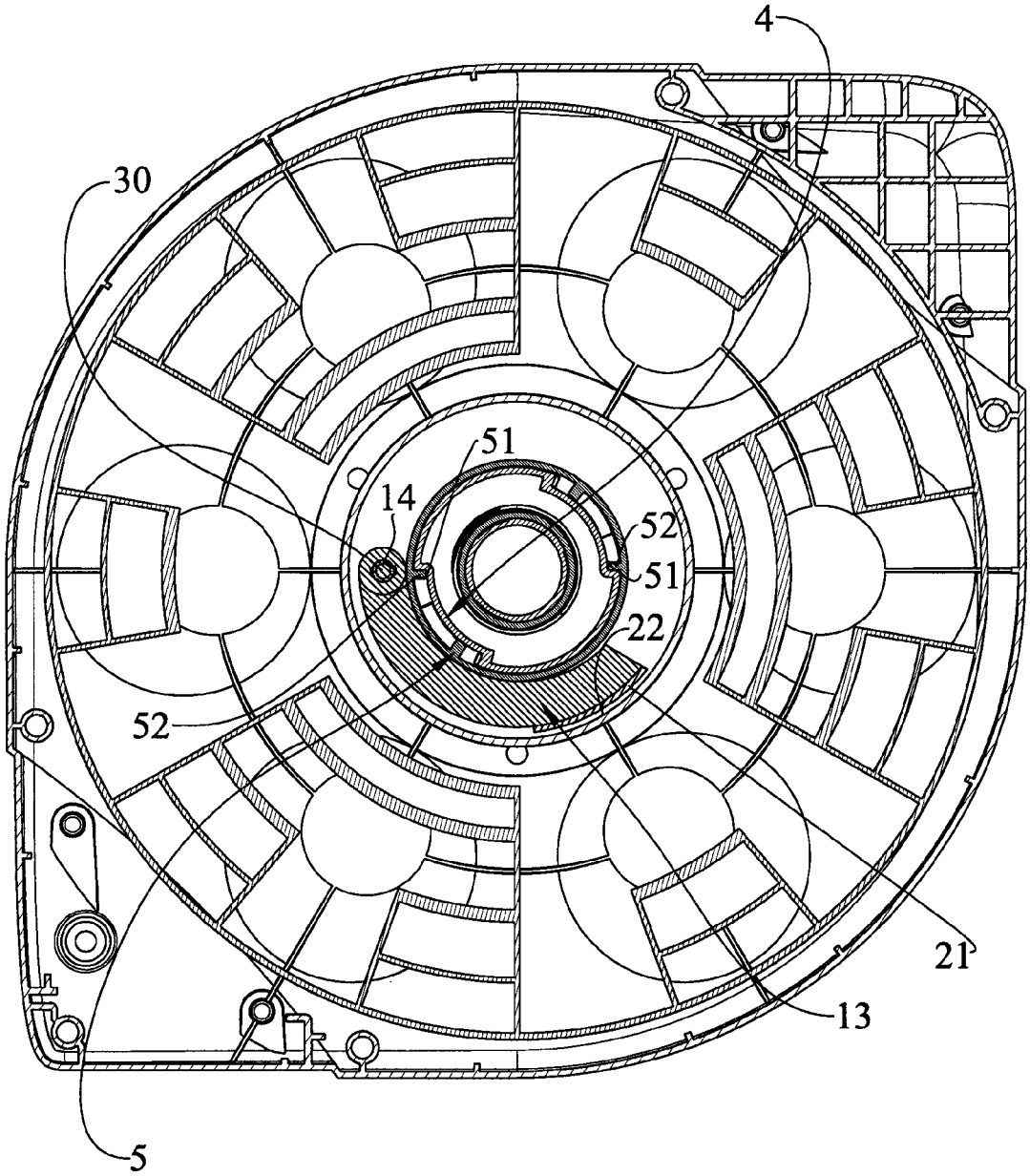
FIG. 6 shows a sectional view along line VI-VI in FIG. 4.
Figure 7:
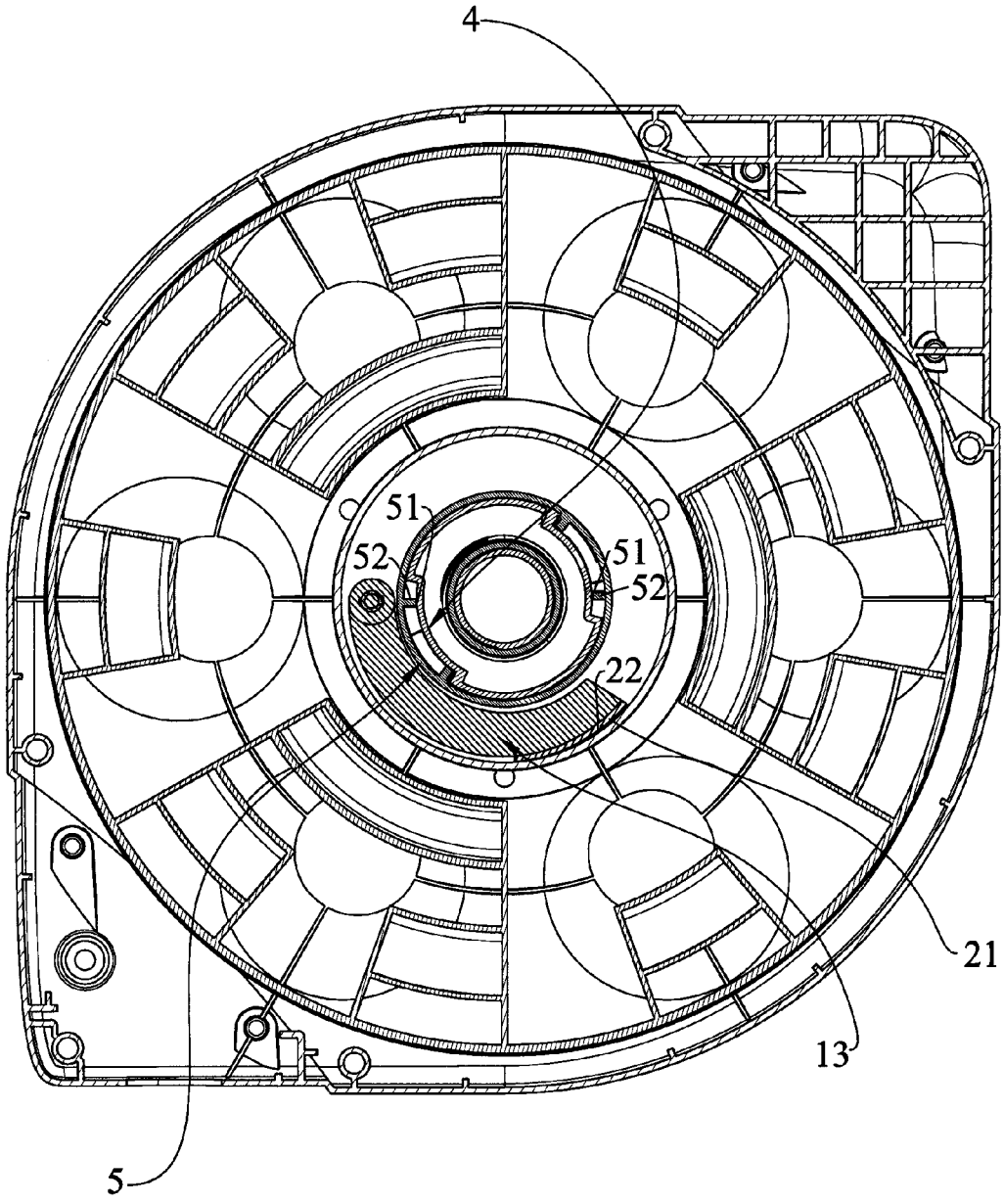
FIG. 7 shows a sectional view along line VII-VII in FIG. 5.

If the flexible hose is now suddenly released, the drum 3 rotates very quickly. The teeth 51 of the flange 4 engage the teeth 52 of the locking disc 5 and cause the locking disc 5 and the flange 4 to rotate together. When the rotational speed of the flange 4 overcomes a given threshold provided by the spring 10, the inclined surfaces of the cams 6 and the counter-cams 7 slide along each other and cause the sleeve 11 of the locking disc 5 to slide along the axis of the connection portion 12 of the flange 4 to move the rim 102 of the locking disc 5 towards the rim 100 of the flange 4. The teeth 8 of the locking disc 5 thus engage the teeth 9 of the casing 1 and cause stopping of the drum 3 (FIG. 5).

The spring 14 keeps the shoe 13 in close contact with surface 15 of disc 5.

Let us now consider the case where the operator releases the unrolled flexible hose progressively, i.e. without sudden acceleration.

If the flexible hose is released progressively, the centrifugal force acting on the shoe 13 causes the external portion 21 of the shoe to frictionally engage the annular surface of the casing 1 to slow the rotary motion of the disc 5 with respect to the drum 3 and the flange 4. As a result of the different rotary motion of the disc 5 and the flange 4, the inclined surfaces of the counter-cams 7 of the locking disc 5 slide along the inclined surfaces of the cams 6 of the flange 4 thereby causing the axial movement of the locking disc 5 until the teeth 8 of the disc 5 engage the teeth 9 of the casing 1 to cause stopping of the drum 3.

Essentially, in the first case the sliding of cams 6 against counter-cams 7, with the consequence that disc 5 approaches flange 4, is caused by the sudden acceleration, sufficient to induce a force such as to overcome the force of separation induced by spring 10.

In the second case, in the absence of a sudden acceleration, shoe 13 must intervene to cause the relative motion between disc 5 and flange 4.

As noted above, the threshold speed is set at the construction stage, taking the following principally into account:

the elastic force of springs 2, 10 and 14;

the connection between disc 5 and flange 4 on drum 3;

the geometry of cams 6 and counter-cams 7;

the sizing of superficial portion 21.

The variant shown in FIGS. 13-16 allows possible failures or breakages of teeth 8 and 9 and the relative supports to be avoided in the event of powerful stresses due the high speed of rewinding.

According to this variant, a friction ring 26 in rubbery material is interposed between stopping disc 25 and casing 1; the interposition is such that the rotation of stopping disc 25 can produce a slight slipping of the latter against friction ring 26.

The effect of the interposition of friction ring 26 is that, in the event of sudden rewinding at a speed which exceeds the threshold speed previously mentioned by an amount such as to be able to cause failure or breakage of teeth 8 and 9 at the moment of their mutual engagement, the stopping disc is induced to rotate slightly, slipping against friction ring 26 before coming to a halt together with drum 1. Teeth 8 and 9 and the respective supports are thus preserved from the risk of breakage through excessively high impact stresses.

The invention claimed is:

1. Hose reel comprising a support casing, a drum rotatably fitted inside said casing and connected to the casing by a rewind spring, a flange integral with the drum and couplable in rotation with a locking disc equipped with teeth and said locking disc being movable between a first position axially distanced from said flange and a second position axially near said flange in which said teeth of the locking disc engage with opposed teeth on the casing capable of arresting rotation of the drum, a separating spring interposed between said flange and said locking disc to maintain the latter in said first position, at least one tooth and at least one counter-tooth respectively integral with said flange and said locking disc which are mutually engaged so as to allow said flange to integrally rotate with said locking disc and said drum, and a cam and counter-cam respectively integral with said flange and said locking disc which in the event of a predetermined threshold speed being exceeded by said flange cause a brake shoe rotating with said locking disc to engage the casing and thereby cause axial displacement of said locking disc into said second position to produce consequent stopping of the rotation of the drum, said opposed teeth being integral with a stopping disc which is axially held against said casing with interposition of a friction ring capable of allowing a limited rotation of said stopping disc with respect to said casing in the event that rotation speed of said locking disc exceeds said predetermined threshold by a pre-established value, said friction ring being made of rubbery material.

2. Hose reel according to claim 1, wherein the locking disc in the first position has teeth said distanced from the opposed teeth and in the second position has said teeth engaged with the said opposed teeth, and the cams and counter-cams of the flange and the locking disc have inclined surfaces engaged with each other so that a speed of rotation of the drum which overcomes said predetermined threshold causes axial displacement of the locking disc to the second position.

3. Hose reel according to claim 1, further comprising said brake shoe rotatably coupled to the locking disc by a spring capable, once said threshold speed has been exceeded, of interacting with a portion of the casing to slow the locking disc with respect to the drum, thus causing engagement of said cam with said counter-cam, with consequent axial approach of said locking disc towards said cam causing locking engagement of the teeth of the locking disc with said opposed teeth, to produce the consequent halting of the rotation of the drum.

4. Hose reel according to claim 3, wherein said brake shoe includes a friction portion capable of interacting with said portion of the casing.

* * * * *